US006666285B2

(12) United States Patent
Jones et al.

(10) Patent No.: US 6,666,285 B2
(45) Date of Patent: Dec. 23, 2003

(54) LOGGING-WHILE-DRILLING APPARATUS AND METHODS FOR MEASURING DENSITY

(75) Inventors: Dale A. Jones, Houston, TX (US); Medhat W. Mickael, Sugar Land, TX (US)

(73) Assignee: Precision Drilling Technology Services Group Inc., Calgary (CA)

( * ) Notice: Subject to any disclaimer, the term of this patent is extended or adjusted under 35 U.S.C. 154(b) by 61 days.

(21) Appl. No.: 10/078,199

(22) Filed: Feb. 15, 2002

(65) Prior Publication Data

US 2003/0155121 A1 Aug. 21, 2003

(51) Int. Cl.[7] ..... E21B 47/00

(52) U.S. Cl. ..... 175/50; 166/254.2; 166/66; 250/254; 250/269.3; 73/152.03; 175/325.1

(58) Field of Search ..... 166/254.1, 254.2, 166/66; 250/254, 268, 269.3; 175/50, 325.1; 73/152.02, 152.03

(56) References Cited

U.S. PATENT DOCUMENTS 5,017,778 A 5/1991 Wraight
5,250,806 A 10/1993 Rhein-Knudsen et al.
5,397,893 A * 3/1995 Minette ..... 250/254
5,451,779 A 9/1995 Spross et al.
5,910,654 A 6/1999 Becker et al.

* cited by examiner

*Primary Examiner*—David Bagnell
*Assistant Examiner*—Jennifer R. Dougherty
(74) *Attorney, Agent, or Firm*—Patrick H. McCollum

(57) ABSTRACT

Logging-while-drilling gamma ray back scatter density system with elements configured to minimize material between sensor and the borehole environs, maximize shielding and collimation efficiency, and increase operational reliability and ruggedness. The system comprises a drill collar with a cavity in the outer wall, and an instrument package containing a sensor. The instrument package is disposed in the cavity and protrudes from the outer wall of the collar. Embodied as a density LWD system, the sensor consists of a gamma ray source and two detectors mounted within an instrument package framework made of high Z shielding material. A stabilized containing an alignment channel in the inner surface is disposed around the collar and receives the protrusion. The source and detectors are preferably positioned within the instrument package so that they fall within a radius defined by the outer surface of the collar. The source is threaded directly into the high Z material framework of the instrument package.

30 Claims, 4 Drawing Sheets

Fig. 2a
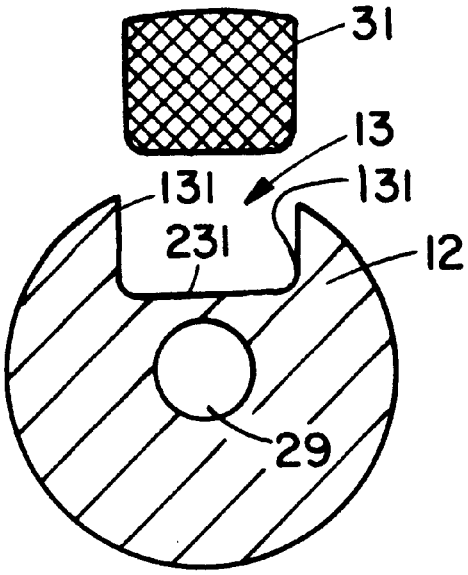
Fig. 2c
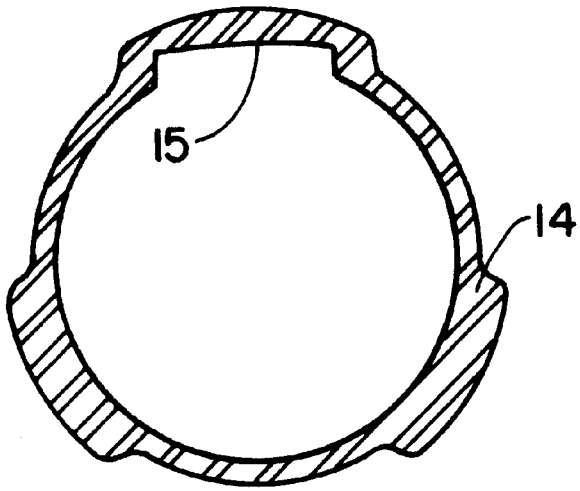
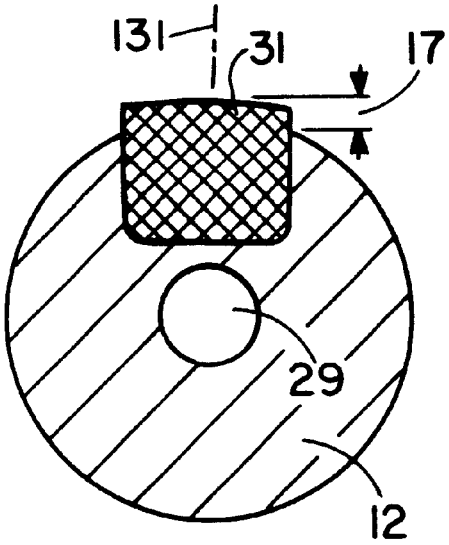
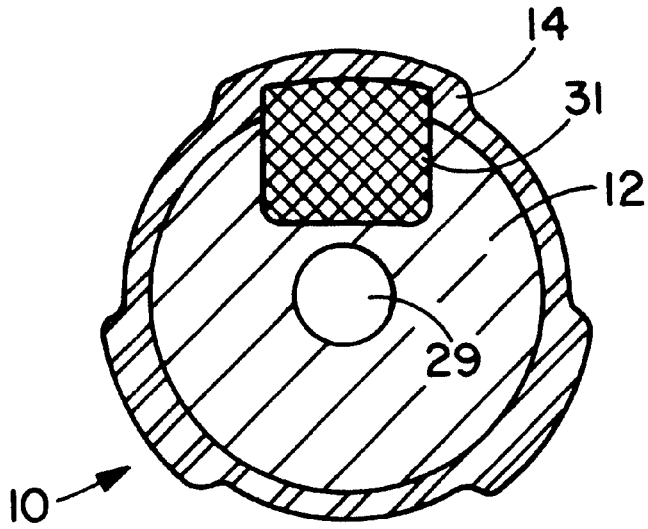
Fig. 2b
Fig. 2d

SECTION A-A

SECTION B-B

SECTION C-C

LOGGING-WHILE-DRILLING APPARATUS AND METHODS FOR MEASURING DENSITY

BACKGROUND OF THE INVENTION

1. Field of the Invention

This invention is directed toward measurement of density of material, and more particularly directed toward a system for measuring bulk density of material penetrated by a borehole. The system is embodied as a logging-while-drilling gamma ray back scatter density system. The system is configured to minimize the distance between active elements of the downhole logging tool and the borehole environs, to minimize material between source and one or more detectors, to maximize shielding and collimation efficiency, and to increase operational reliability and ruggedness.

2. Background of the Art

Systems utilizing a source of radiation and a radiation detector have been used in the prior art for many years to measure density of material. One class of prior art density measuring systems is commonly referred to as "transmission" systems. A source of nuclear radiation is positioned on one side of material whose density is to be measured, and a detector which responds to the radiation is positioned on the opposite side. After appropriate system calibration, the intensity of measured radiation can be related to the bulk density of material intervening between the source and the detector. This class of systems is not practical for borehole geometry since the borehole environs sample to be measured surrounds the measuring instrument or borehole "tool". A second class of prior art density measuring systems is commonly referred to as "back scatter" systems. Both a source of nuclear radiation and a detector, which responds to the radiation, are positioned on a common side of material whose density is to be measured. Radiation impinges upon and interacts with the material, and a portion of the impinging radiation is scattered by the material and back into the detector. After appropriate system calibration, the intensity of detected scattered radiation can be related to the bulk density of the material. This class of systems is adaptable to borehole geometry.

Back scatter type systems have been used for decades to measure density of material, such as earth formation, penetrated by a borehole. Typically density is measured as a function of position along the borehole thereby yielding a "log" as a function of depth within the borehole. The measuring tool typically comprises a source of radiation and at least one radiation detector, which is axially aligned with the source and typically, mounted within a pressure tight container.

Systems that employ the back scatter configuration with a source of gamma radiation and one or more gamma ray detectors are commonly referred to as "gamma-gamma" systems. Sources of gamma radiation are typically isotopic such as cesium-137 ($^{137}$Cs), which emits gamma radiation with energy of 0.66 million electron volts (MeV) with a half life of 30.17 years. Alternately, cobalt-60 ($^{60}$Co) is used as a source of 1.11 and 1.33 MeV gamma radiation with a half life of 5.27 years. The one or more gamma ray detectors can comprise ionization type detectors, or alternately scintillation type detectors if greater detector efficiency and delineation of the energy of measured scattered gamma radiation is desired.

The basic operational principles of prior art, gamma-gamma type back scatter density measurement systems are summarized in the following paragraph. For purposes of discussion, it will be assumed that the system is embodied to measure the bulk density of material penetrated by a borehole, which is commonly referred to as a density logging system. It should be understood, however, that other back scatter density sensitive systems are known in the prior art. These systems include tools which use other types of radiation sources such as neutron sources, and other types of radiation detectors such as detectors which respond to neutron radiation or a combination of gamma radiation and neutron radiation.

A back scatter gamma-gamma density logging tool is conveyed along a well borehole penetrating typically earth formation. Means of conveyance can be a wireline and associated surface draw works. This method is used to obtain measurements subsequent to the drilling of the borehole. Means of conveyance can also be a drill string cooperating with a drilling rig. This method is used to obtain measurements while the borehole is being drilled. Gamma radiation from the source impinges upon material surrounding the borehole. This gamma radiation collides with electrons within the earth formation material and loses energy by means of several types of reaction. The most pertinent reaction in density measurement is the Compton scatter reaction. After undergoing typically multiple Compton scatters, a portion of the emitted gamma radiation is scattered back into the tool and detected by the gamma radiation detector. The number of Compton scatter collisions is a function of the electron density of the scattering material. Stated another way, the tool responds to electron density of the scattering earth formation material. Bulk density rather than electron density is usually the parameter of interest. Bulk density and electron density are related as $$\rho_e=\rho_b(2(\Sigma Z_i)/MW) \tag{1}$$

where $\rho_e$=the electron density index;

$\rho_b$=the bulk density;

$(\Sigma Z_i)$=the sum of atomic numbers $Z_i$ of each element i in a molecule of the material; and MW=the molecular weight of the molecule of the material.

For most materials within earth formations, the term $(2(\Sigma Z_i)/MW)$ is approximately equal to one. Therefore, electron density index $\rho_e$ to which the tool responds can be related to bulk density $\rho_b$, which is typically the parameter of interest, through the relationship $$\rho_b=A\rho_e+B \tag{2}$$

where A and B are measured tool calibration constants. Equation (2) is a relation that accounts for the near linear (and small) change in average Z/A that occurs as material water fraction changes with material porosity, and hence changes with bulk density.

The radial sensitivity of the density measuring system is affected by several factors such as the energy of gamma radiation emitted by the source, the axial spacing between the source and one or more gamma ray detectors, and properties of the borehole and the formation. Formation in the immediate vicinity of the borehole is usually perturbed by the drilling process, and more specifically by drilling fluid that "invades" the formation in the near borehole region. Furthermore, particulates from the drilling fluid tend to buildup on the borehole wall. This buildup is commonly referred to as "mudcake", and adversely affects the radial sensitivity of the system. Intervening material in a displacement or "stand off" of the tool from the borehole wall will adversely affect radial sensitivity of the system. Intervening material in the tool itself between the active elements of the tool and the outer radial surface of the tool will again adversely affect radial tool sensitivity. Typical sources are isotropic in that radiation is emitted with essentially radial symmetry. Flux per unit area decreases as the inverse square of the distance to the source. Radiation per unit area scattered by the formation and back into detectors within the tool also decreases as distance, but not necessarily as the inverse square of the distance. In order to maximize the statistical precision of the measurement, it is desirable to dispose the source and the detector as near as practical the borehole environs, while still maintaining adequate shielding and collimation.

In view of the above discussion, it is of prime importance to maximize the radial depth of investigation of the tool in order to minimize the adverse effects of near borehole conditions. It is also of prime importance to position active elements of the logging system, namely the source and one or more detectors, as near as possible to the outer radial surface of the tool while still maintaining collimation and shielding required for proper tool operation.

Generally speaking, the prior art teaches that an increase in axial spacing between the source and the one or more detectors increases radial depth of investigation. Increasing source to detector spacing, however, requires an increase in source intensity in order to maintain acceptable statistical precision of the measurement. Prior art systems also use multiple axial spaced detectors, and combine the responses of the detectors to "cancel" effects of the near borehole region. Depth of investigation can be increased significantly by increasing the energy of the gamma-ray source. This permits deeper radial transport of gamma radiation into the formation. Prior art wireline logging systems use a variety of bow springs and hydraulically operated pad devices to force the active elements of a density logging system against the borehole wall thereby minimizing standoff. Prior art LWD systems use a variety of source and detector geometries to minimize standoff, such as placing a gamma ray source and one or more gamma ray detectors within stabilizer fins that radiate outward from a drill collar. This also tends to minimize intervening material within the tool, and position source and detectors near the borehole environs, but often at the expense of decreasing the efficiency of shielding and collimation. Furthermore, this approach introduces certain operational problems in that harsh drilling conditions can break away stabilizer fins resulting in the loss of the instrument, and more critical the loss of a radioactive source, in the borehole. Yet other prior LWD systems dispose a source and one or more detectors within a drill collar with a stabilizer disposed between source and detectors and the borehole and formation. This is more robust operationally, but the amount of intervening material between active tool elements and the borehole environs is increased. Distance between the source and detectors, and the surrounding borehoke environs, is also not minimized.

SUMMARY OF THE INVENTION

This invention is directed toward a logging-while-drilling (LWD) gamma ray back scatter density system wherein elements are configured to place a sensor preferably comprising a source and one or more detectors as near as practical to the borehole environs, to maximize shielding and collimation efficiency, and to increase operational reliability and ruggedness. It should be understood, however, that the basic concepts of the invention can be employed in other types and classes of LWD logging systems. As an example, concepts of the invention can be used in a neutron porosity system for measuring formation porosity, wherein the sensor comprises a neutron source and one or more neutron detectors. As another example, concepts of the invention can be used in natural gamma radiation system for measuring shale content and other formation properties, wherein the sensor comprises one or more gamma ray detectors. Basic concepts of the system can be used in other classes of LWD logging systems including electromagnetic and acoustic systems.

The tool element of the LWD system is conveyed by a drill string along the borehole penetrating an earth formation. A drill bit terminates the drill string. The drill string is operated by a standard rotary drilling rig, which is well known in the art. The LWD tool comprises three major elements. The major first element is a drill collar with an axial passage through which drilling fluid flows, and which also contains a cavity within the collar wall and opening to the outer surface of the collar. The second major element is an instrument package that is disposed within the cavity and which protrudes radially outward from the outer surface of the collar. The third major element is a stabilized, which is disposed circumferencially around the outer collar surface. An axial alignment channel is formed on the inner surface of the stabilizer and is sized to receive the protruding portion of the instrument package.

The system is preferably embodied as a gamma-gamma density logging system, although basic concepts of the invention can be used in other types or classes of LWD systems. The instrument package comprises a source of gamma radiation and one or more gamma ray detectors. Two detectors are preferred so that previously discussed data processing methods, such as the "spine and rib" method, can be used to minimize adverse effects of the near borehole environment. The source is preferably cesium-137 ($^{137}Cs$) which emits gamma radiation with an energy of 0.66 million electron volts (MeV). Alternately, cobalt-60 ($^{60}Co$) emitting gamma radiation at 1.11 and 1.33 MeV can be used as source material. The source is affixed to a source holder that is mounted in directly into shielding in the instrument package rather than mounting into or through the collar as in prior art systems. This source mounting offers various mechanical, operational and technical advantages as will be discussed subsequently. The detectors are preferably scintillation type such as sodium iodide or bismuth germinate to maximize detector efficiency for a given detector size.

The instrument package framework is fabricated with a high atomic number material, commonly referred to as "high Z" material. High Z material is an efficient attenuator of gamma radiation, and permits the efficient shielding, collimation and optimum disposition of the source and detectors with respect to the borehole environs. A pathway in the high Z instrument package leading from the source to the stabilizer forms a source collimator window. The source collimator window is filled with a material that is relatively transparent to gamma radiation. Such material is commonly known as a "low Z" material, and includes materials such as a ceramic, plastics and epoxies. The axis of the source collimator window is in a plane defined by the major axis of the collar and the radial center of the instrument package. Pathways in the instrument package leading from each detector to the stabilizer form detector collimator windows. Again, axes of the detector collimator windows are in the plane defined by the major axis of the collar and the radial center of the instrument package, and the windows are filled with low Z material. The stabilizer comprises windows over the collimator windows that are fabricated with low Z material and, therefore, are also relatively transparent to gamma radiation. Power supplies and electronic circuitry, used to power and operate the detectors, are preferably remote from the instrument package.

The instrument package is disposed within the cavity in the drill collar, with the protruding portion fitting within the axial alignment channel of the surrounding stabilizer. The instrument package is preferably removably disposed within the cavity using threaded fasteners or the like. This arrangement permits relatively easy replacement of the entire instrument package in the event of malfunction thereby increasing operational efficiency. Because a portion of the instrument package is positioned within the alignment channel, source and detector elements are moved radially outward thereby minimizing the distance between these elements and the borehole environments. This, in turn, reduces the amount of intervening material between these elements therefore making the system more responsive to the borehole environs. Furthermore, this geometrical arrangement maximizes the gamma ray flux per unit area entering the borehole environs, and also maximizes the flux per unit area of gamma radiation returning to the detectors. The source is preferably mounted in the instrument package by threading into a small, mechanically suitable insert disposed within the instrument package shielding material. This arrangement yields maximum radial shielding and collimation of the source, even though design criteria discussed above minimize radial spacing between the source and the borehole environs. A substantial portion of the instrument section, including the gamma ray source, is preferably disposed in the cavity within the collar. This design produces a physically robust system, wherein the loss of the source would be minimized in the event that stabilizer protrusions were lost during the drilling operation. For an instrument package with fixed dimensions, the gamma ray source may be disposed outside of the cavity when collars of relatively small diameter are used.

BRIEF DESCRIPTION OF THE DRAWINGS

So that the manner in which the above recited features, advantages and objects of the present invention are obtained and can be understood in detail, more particular description of the invention, briefly summarized above, may be had by reference to the embodiments thereof which are illustrated in the appended drawings.

FIG. 2*a* is a cross sectional view showing the collar and instrument package elements of the borehole logging tool;

FIG. 2*b* is a cross sectional view of the instrument package disposed within the collar and forming a protrusion from the outer collar surface;

FIG. 2*c* is a cross sectional view showing the stabilizer element of the tool with an alignment channel formed on the inner surface of the stabilizer;

FIG. 2*d* is a cross sectional view of the three major elements of the tool assembled with the instrument package protrusion received by the stabilizer alignment channel;

DETAILED DESCRIPTION OF THE PREFERRED EMBODIMENTS

The present disclosure is directed toward a logging-while-drilling (LWD) gamma ray back scatter density system, wherein elements are configured to place the source and one or more detectors as near as practical to the borehole environs, to maximize shielding and collimation efficiency, and to increase operational reliability and ruggedness. It should be understood, however, that the basic concepts of the invention can be employed in other classes and types LWD logging systems. These alternate embodiments include "natural" gamma ray systems used to determine formation shale content and other parameters, and systems employing a source of neutrons to and one or more detectors to determine formation porosity and other properties.

Figure 1:
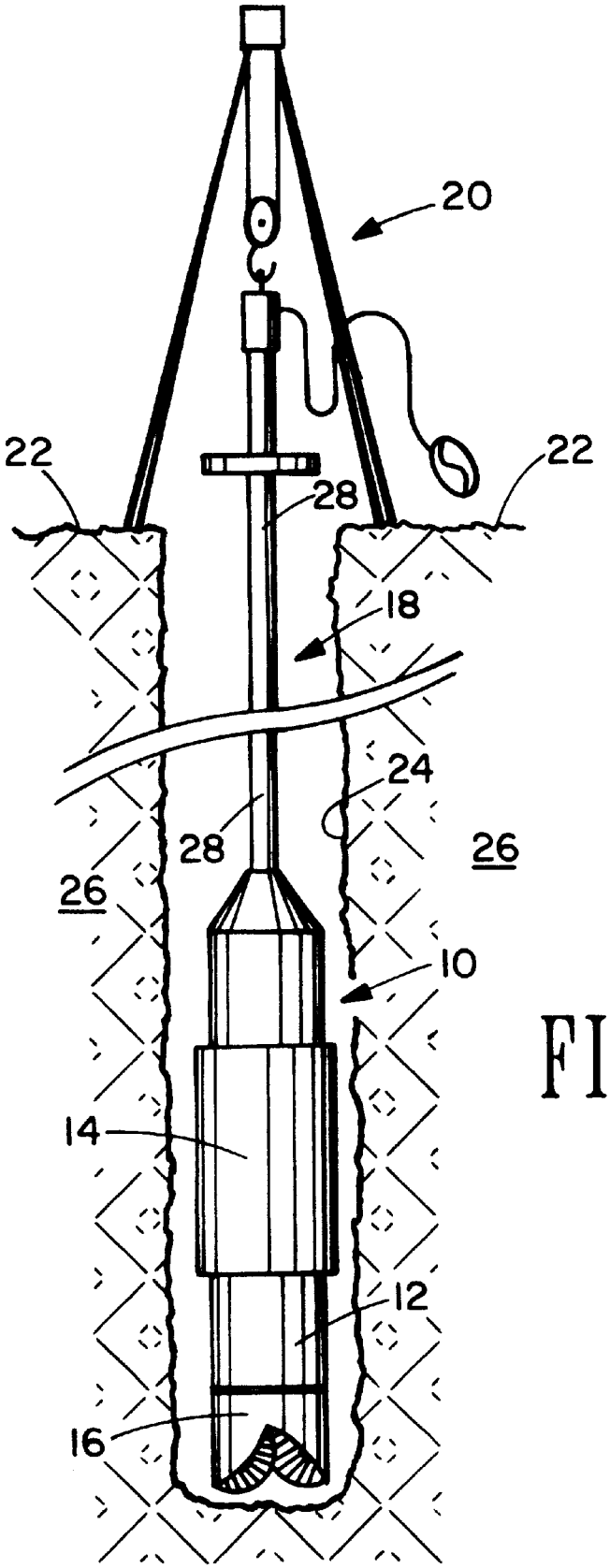
FIG. 1 illustrates the density system embodied as a logging-while-drilling system.

FIG. 1 illustrates the LWD tool, identified as a whole by the numeral 10, disposed by means of a drill string within a well borehole 18 defined by a borehole wall 24 and penetrating an earth formation 26. The upper end of the collar element 12 of the tool 10 is operationally attached to the lower end of a string of drill pipe 28. The stabilizer element of the tool 10 is identified by the numeral 14. The lower end of logging tool 10 is terminated by a drill bit 16. It should be understood, however, that other elements can be disposed on either end of the tool 10 between the drill pipe 28 and the drill bit 16. The upper end of the drill pipe 28 terminates at a rotary drilling rig 20 at the surface of the earth 22. The drilling rig rotates the drill pipe 28 and cooperating tool 10 and drill bit 16 thereby advancing the borehole 18. Drilling mud is circulated down the drill pipe 28, through the axial passage in the collar 12, and exits at the drill bit 16 for return to the surface 22 via the annulus defined by the outer surface of the drill string and the borehole wall 24. Details of the construction and operation of the drilling rig 20 are well known in the art, and are omitted in this disclosure for brevity.

Attention is directed to FIGS. 2*a*–2*d,* which illustrate conceptually the three major elements of the tool 10 shown in cross sections perpendicular to the major axis of the tool. In FIG. 2*a*, a cross section view through the major axis of the collar 12 illustrates a conduit 29 through which drilling fluid is circulated during the drilling process. Also illustrated is a cavity 13 that is sized to receive the instrument package element of the tool, denoted as a whole by the numeral 31. The cavity preferably extends axially along the major axis of the tool 10 with opposing walls 131 defining parallel planes that are normal to an inner surface 231. The radial center of the instrument section 31 is identified as 131. FIG. 2*b* illustrates the instrument package 31 disposed within the cavity 13 with a portion of the package radially protruding a distance identified at 17. FIG. 2*c* is a cross section of the stabilizer element 14 of the tool 10. A alignment channel 15 is fabricated on the inner surface of the stabilizer element 14 and is dimensioned to receive the protruding portion (see FIG. 2*b*) of the instrument package 31. For ease of manufacturing, the alignment channel 15 is extended the entire length of the stabilizer element 14. FIG. 2*d* illustrates the tool 10 fully assembled with the instrument package 31 disposed within the cavity 13 of the collar 12 and within the alignment channel 15 of the stabilizer 14.

Figure 3:
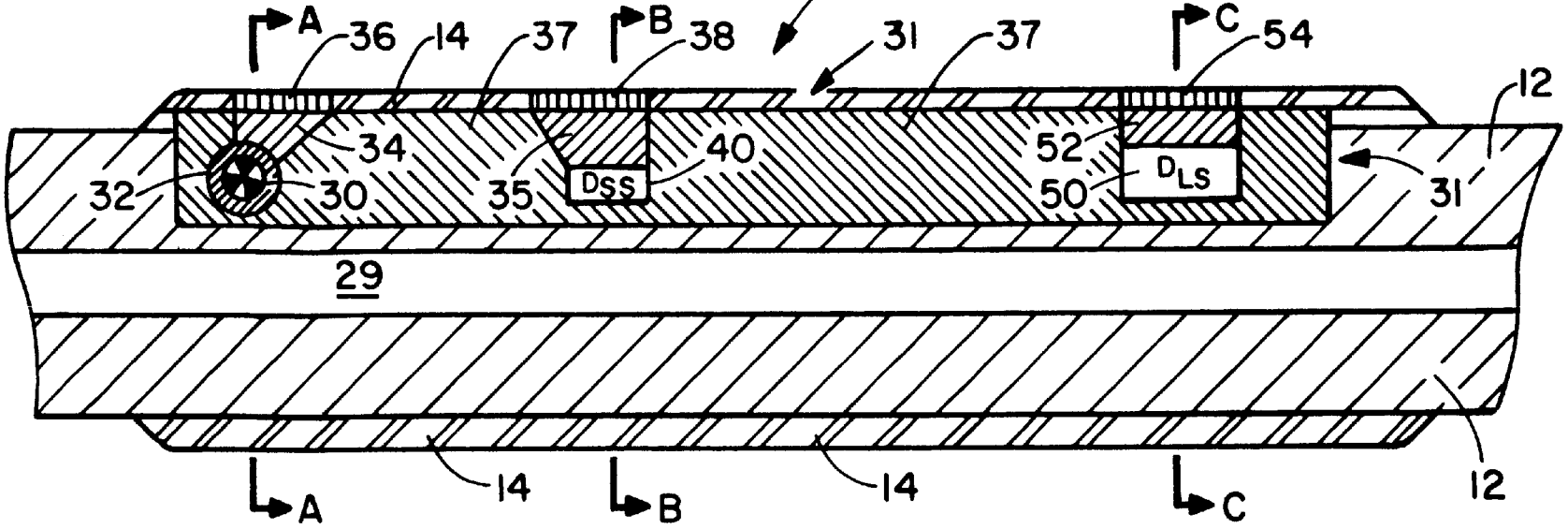
FIG. 3 is a side view of the tool assembly.

FIG. 3 is a sectional view of the logging tool 10 along the major axis of the tool. The instrument package 31 comprises a source of gamma radiation 30, a first or "short spaced"

gamma ray detector 40 disposed at a first axial distance from the source, and a second or "long spaced" gamma ray detector 50 disposed at a second axial distance from the source, where the second spacing is greater than the first spacing. The source 30 is preferably cesium-137 ($^{137}Cs$) which emits gamma radiation with an energy of 0.66 million electron volts (MeV). Alternately, cobalt-60 ($^{60}Co$) emitting gamma radiation at 1.11 and 1.33 MeV can be used as source material.

Still referring to FIG. 2, the instrument package frame is fabricated from a high atomic number material 37, commonly referred to as "high Z" material. High Z material 37 is an efficient attenuator of gamma radiation, and permits the efficient shielding, collimation and optimum disposition of the source 30 and short spaced and long spaced detectors 40 and 50, respectively, with respect to the borehole environs. Detector volumes are preferably as small as possible in order to maximize the surrounding shielding and collimation material. The short spaced and long spaced detectors 40 and 50 are, therefore, preferably of the scintillator type to increase detection efficiencies for given detector volumes. Sodium iodide or bismuth germinate are suitable scintillation crystal materials to be used in the scintillation type detectors. Tungsten (W) is a suitable high Z material for the framework of the instrument package 31.

Still referring to FIG. 3, a pathway in the high Z material 37 leading radially outward from the source to the stabilizer forms a source collimator window 34 which is filled with low Z material. At least a portion of the wall of the source collimator window 34 (as shown in FIG. 3) preferably forms an acute angle with the axis of the tool 10 to better focus gamma radiation into the formation and thereby enhance sensitivity to the Compton scatter reactions summarized in equations (1) and (2). The axis the source collimator window 34 is in a plane defined by the major axis of the collar and the radial center 131 of the instrument package.

The source 30 is affixed to a source holder 132 (best seen in FIG. 4) which is removably mounted directly within the instrument package 31 rather than mounted into or through the collar 12 as in prior art systems. In addition to offering operational advantages, this method for removably mounting and positioning allows the shielding material 37 in the immediate vicinity of the source 30 to be maximized, while maintaining maximum radial positioning of the source within the tool. This, in turn, maximizes the flux per unit area impinging upon the borehole environs which, for a given source strength and detector efficiencies, optimizes the statistical precision of the density measurements. Threaded fixtures are the preferred apparatus for removably mounting the source holder within the instrument package 31. Other apparatus, such as J-latch system, can be used for removably mounting the source holder 132 within the instrument package. The preferred tungsten high Z material 37 tends to be brittle. Threading tungsten directly to receive the source holder assembly 132 for the source 30 would tend to introduce source holder fracturing and breakage. A thin walled insert 32 is disposed in the tungsten shielding 37 to enhance the mechanical properties of the assembly. The insert 32 is more suitable for receiving the threaded source holder 132 and thereby reduces chance of female thread cracking or other types of damage in the tungsten shielding material 37. The insert 32 is sufficiently small in volume so that it does not adversely affect the shielding and collimation of the source 30.

As shown in FIG. 3, a pathway in the material 37 leading radially outward from the short spaced detector 40 defines a short spaced detector collimator window 35 filled with low Z material. A pathway in the material 37 leading radially outward from the long spaced detector 50 defines a long spaced detector collimator window 52 filled with low Z material. Again, axes of the long and short spaced detector collimator windows 35 and 52, respectively, are in the plane defined by the major axis of the collar and the radial center 131 of the instrument package. Preferably, a portion of the wall of at least the short spaced detector collimator window 35 (as shown in FIG. 3) forms an acute angle with the axis of the tool 10 to enhance sensitivity to angular sensitive Compton scattered gamma radiation emanating at preferred scatter angles from the borehole environs. Optionally, the long spaced detector collimator window 52 can also be angularly collimated, but angular dependence of detected radiation decreases with source-detector spacing. The preferred low Z material filling the collimator windows is epoxy.

An electronics package, comprising power supplies (not shown) and electronic circuitry (not shown) required to power and control the detectors, is not located within the instrument package 31, but located elsewhere in the logging system. The electronics package is electrically connected to the detectors. The electronics packages can also include recording and memory elements to store measured data for subsequent retrieval and processing when the tool 10 is returned to the surface of the earth.

Referring again to FIG. 3, the stabilizer 14 comprises low Z inserts over the source and detector collimator windows that are relatively transparent to gamma radiation. More specifically, a low Z insert 36 is disposed within the stabilized over the opening of the source collimator window 34. Likewise, low Z inserts 38 and 54 are disposed over collimator window openings 35 and 52 for the short spaced detector 40 and long spaced detector 50, respectively. The preferred insert is a machined thermoplastic plug. Alternately, the inserts can be fabricated from other low Z materials including epoxies, ceramics and low Z metals such as beryllium.

Figure 4:
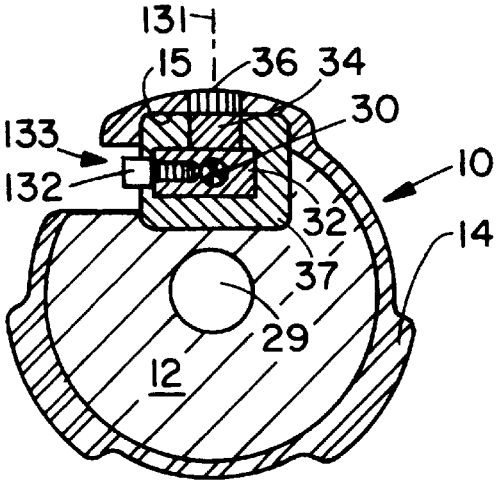
FIG. 4 is a cross sectional view of the tool through the source assembly.

FIG. 4 is a sectional view of the tool 10 at A—A that better shows the source mounting and collimation. The source holder 132 is threaded into the insert 32 through an opening 133 in the stabilizer 14. Dimensions are sized so that the source 30 is aligned with radial center lines of the source collimator window 34 and the low Z window 36. Note that the previously described protrusion of the instrument package 31 fits into the alignment channel 15, but the source lies within a radius defined by the outer surface of the collar 12. This offers protection to the source in the event that the stabilizer is damaged during drilling operations.

Figure 5:
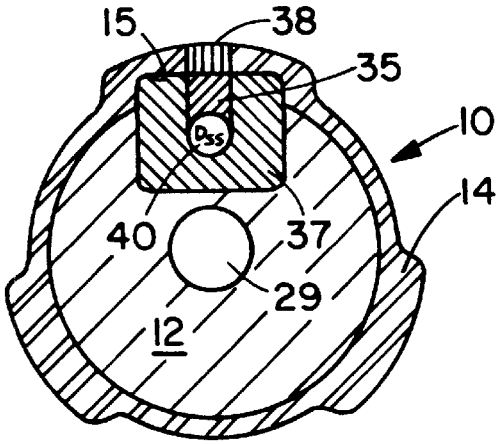
FIG. 5 is a cross sectional view of the tool through the short spaced detector assembly.

FIG. 5 is a sectional view of the tool 10 at B—B through the short spaced detector 40. The detector center line is radially aligned with the radial center lines of the collimator window 35 and short spaced detector window 38. Note that the short spaced detector 40 also lies within the radius defined by the outer surface of the collar 12.

Figure 6:
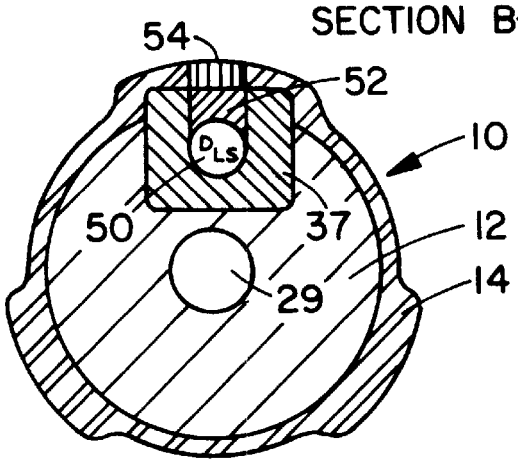
FIG. 6 is a cross sectional view of the tool through the long spaced detector assembly.

FIG. 6 is a sectional view of the tool 10 at C—C through the long spaced detector 50. The detector center line is radially aligned with the radial center lines of the collimator window 52 and long spaced detector window 54. Note that the long spaced detector 50, like the short spaced detector 40 and the source 30, lies within a radius defined by the outer surface of the collar 12.

For an instrument package with fixed dimensions, the gamma ray source and detectors may be at least partially disposed outside of the cavity when collars of relatively small diameter are used.

The system is disclosed in detail as a nuclear class LWD system embodied as a gamma—gamma density system, with the sensor comprising a gamma ray source and two axially spaced gamma ray detectors. The basic concepts of the invention can be used with other types of sensors in other types and classes of LWD systems. As an example, the invention can be embodied as a neutron porosity LWD system, wherein the sensor comprises a neutron source and preferably two axially spaced neutron detectors. The sensor responds primarily to hydrogen content of the borehole which, in turn, can be related to formation porosity. As another example, the invention can be embodied as a natural gamma ray LWD system, wherein the sensor comprises one or more gamma ray detectors. Sensor response can be related to shale content and other formation properties. The invention can also be embodied as other classes of LWD systems including electromagnetic and acoustic.

While the foregoing disclosure is directed toward the preferred embodiments of the invention, the scope of the invention is defined by the claims, which follow.

What is claimed is:

1. An LWD logging system comprising:

(a) a drill collar comprising
  (i) a collar wall defined by an inner collar surface and an outer collar surface, and
  (ii) a cavity within said collar wall and opening at said outer collar surface;

(b) an instrument package comprising a sensor, wherein said instrument package is disposed within said cavity and forms a radial protrusion from said outer collar surface; and (c) a stabilizer disposed circumferentially around said outer collar surface, wherein said stabilizer comprises
  (i) a stabilizer wall defined by an inner stabilizer surface and an outer stabilizer surface, and
  (ii) an axial alignment channel within said stabilizer wall and opening to said inner stabilizer surface, and wherein
  (iii) said axial alignment channel receives said radial protrusion.

2. The system of claim 1 wherein said sensor comprises:

(a) a gamma ray source;

(b) a short spaced gamma ray detector spaced axially at a first distance from said gamma ray source; and (c) a long spaced gamma ray detector spaced axially at a second distance from said gamma ray source, wherein said second distance is greater than said first distance.

3. The system of claim 2 wherein said gamma ray source, said short spaced detector and said long spaced detector are disposed in said instrument package within a radius defined by said outer collar surface.

4. The system of claim 2 wherein framework of said instrument package is high Z material.

5. The system of claim 4 wherein said gamma ray source is removably mounted within said instrument package framework.

6. The system of claim 5 further comprising:

(a) a first pathway in said high Z material extending radially outward from said source to said inner stabilizer surface thereby forming a source collimator window, wherein the axis of said source collimator window is in a plane defined by the major axis of said collar and the radial center of said instrument package, and wherein said source collimator window is filled with low Z material;

(b) a second pathway in said high Z material extending radially outward from said short spaced detector to said inner stabilizer surface thereby forming a short spaced detector collimator window, wherein the axis of said short spaced detector collimator window is in a plane defined by the major axis of said collar and said radial center of said instrument package, and wherein said short spaced detector collimator window is filled with said low Z material; and (c) a third pathway in said high Z material extending radially outward from said long spaced detector to said inner stabilizer surface thereby forming a long spaced detector collimator window, wherein the axis of said long spaced detector collimator window is in a plane defined by the major axis of said collar and said radial center of said instrument package, and wherein said long spaced detector collimator window is filled with said low Z material.

7. The system of claim 6 further comprising:

(a) a first low Z insert that
  (i) is disposed within said stabilizer wall
  (ii) extends radially from said inner stabilizer surface to said outer stabilizer surface, and
  (iii) terminates said first pathway;

(b) a second low Z insert that
  (i) is disposed within said stabilizer wall
  (ii) extends radially from said inner stabilizer surface to said outer stabilizer surface, and
  (iii) terminates said second pathway; and (c) a third low Z insert that
  (i) is disposed within said stabilizer wall
  (ii) extends radially from said inner stabilizer surface to said outer stabilizer surface, and
  (iii) terminates said third pathway.

8. The system of claim 6 wherein said axis of said source collimator window forms an acute angle with said major axis of said collar.

9. The system of claim 6 wherein said axis of said short spaced detector collimator window forms an acute angle with said major axis of said collar.

10. The system of claim 2 wherein said gamma ray source comprises cesium-137.

11. An LWD density logging system comprising:

(a) a drill collar comprising
  (i) a collar wall defined by an inner collar surface and an outer collar surface, and
  (ii) a cavity within said collar wall and opening at said outer collar surface;

(b) an instrument package with a radial center and comprising a high Z framework and which is removably disposed within said cavity and which forms a radial protrusion from said outer collar surface, wherein said instrument package further comprises
  (i) a cesium-137 gamma ray source threaded into said framework,
  (ii) a short spaced gamma ray detector spaced axially at a first distance from said gamma ray source,
  (iii) a long spaced gamma ray detector spaced axially at a second distance from said gamma ray source, wherein said second distance is greater than said first distance,
  (iv) a first pathway in said high Z material extending radially outward from said source to said inner stabilizer surface thereby forming a source collimator window, wherein the axis of said source collimator window is in a plane defined by the major axis of said collar and said radial center of said instrument package, and wherein said source collimator window is filled with low Z material, (v) a second pathway in said high Z material extending radially outward from said short spaced detector to said inner stabilizer surface thereby forming a short spaced detector collimator window, wherein the axis of said short spaced detector collimator window is in a plane defined by said major axis of said collar and said radial center of said instrument package, and wherein said short spaced detector collimator window is filled with said low Z material, and (vi) a third pathway in said high Z material extending radially outward from said long spaced detector to said inner stabilizer surface thereby forming a long spaced detector collimator window, wherein the axis of said long spaced detector collimator window is in a plane defined by said major axis of said collar and said radial center of said instrument package, and wherein said long spaced detector collimator window is filled with said low Z material, and wherein (vii) said source and said short spaced detector and said long spaced detector are disposed in said instrument package within a radius defined by said outer collar surface; and (c) a stabilizer disposed circumferentially around said outer collar surface, wherein said stabilizer comprises (i) a stabilizer wall defined by an inner stabilizer surface and an outer stabilizer surface, (ii) an axial alignment channel within said stabilizer wall and opening to said inner stabilizer surface, (iii) a first low Z insert that is disposed within said stabilizer wall and extends radially from said inner stabilizer surface to said outer stabilizer surface and terminates said first pathway, (iv) a second low Z insert that is disposed within said stabilizer wall and extends radially from said inner stabilizer surface to said outer stabilizer surface and terminates said second pathway, and (v) a third low Z insert that is disposed within said stabilizer wall and extends radially from said inner stabilizer surface to said outer stabilizer surface and terminates said third pathway, and wherein (vi) said axis of said source collimator window forms an acute angle with said major axis of said collar, (vii) said axis of said first detector collimator window forms an acute angle with said major axis of said collar, and (viii) said axial alignment channel receives said radial protrusion.

12. The system of claim 11 wherein said low Z material is epoxy.

13. The system of claim 11 wherein said first low Z insert and said second low Z insert and said third low Z insert are machined thermoplastic plugs.

14. A method for logging while drilling a well borehole, comprising the steps of:

(a) providing a drill collar with a collar wall defined by an inner collar surface and an outer collar surface, and forming a cavity within said collar wall with and opening at said outer collar surface;

(b) providing an instrument package comprising a sensor;

(c) disposing said instrument package within said cavity and so that it forms a radial protrusion from said outer collar surface; and (d) disposing circumferentially a stabilizer around said outer collar surface, wherein said stabilizer comprises (i) a stabilizer wall defined by an inner stabilizer surface and an outer stabilizer surface, and (ii) an axial alignment channel within said stabilizer wall and opening to said inner stabilizer surface, and wherein (iii) said axial alignment channel receives said radial protrusion.

15. The method of claim 14 wherein said sensor comprises:

(a) a gamma ray source;

(b) a short spaced gamma ray detector spaced axially at a first distance from said gamma ray source; and (c) a long spaced gamma ray detector spaced axially at a second distance from said gamma ray source, wherein said second distance is greater than said first distance.

16. The method of claim 15 comprising the additional steps of disposing said gamma ray source, said short spaced detector and said long spaced detector in said instrument package within a radius defined by said outer collar surface.

17. The method of claim 15 wherein framework of said instrument package is high Z material.

18. The method of claim 17 comprising the additional steps of:

(a) forming a first pathway in said high Z material that extends radially outward from said source to said inner stabilizer surface thereby forming a source collimator window, wherein the axis of said source collimator window is in a plane defined by the major axis of said collar and the radial center of said instrument package, and wherein said source collimator window is filled with low Z material;

(b) forming a second pathway in said high Z material that extends radially outward from said short spaced detector to said inner stabilizer surface thereby forming a short spaced detector collimator window, wherein the axis of said short spaced detector collimator window is in a plane defined by the major axis of said collar and said radial center of said instrument package, and wherein said short spaced detector collimator window is filled with said low Z material; and (c) forming a third pathway in said high Z material that extends radially outward from said long spaced detector to said inner stabilizer surface thereby forming a long spaced detector collimator, wherein the axis of said long spaced detector collimator is in a plane defined by the major axis of said collar and said radial center of said instrument package, and wherein said long spaced detector collimator window is filled with said low Z material.

19. The method of claim 18 further comprising:

(a) disposing a first low Z insert within said stabilizer wall that (i) extends radially from said inner stabilizer surface to said outer stabilizer surface, and (ii) terminates said first pathway;

(b) disposing a second low Z insert within said stabilizer wall that (i) extends radially from said inner stabilizer surface to said outer stabilizer surface, and (ii) terminates said second pathway; and (c) disposing a third low Z insert within said stabilizer wall that (i) extends radially from said inner stabilizer surface to said outer stabilizer surface, and (ii) terminates said third pathway.

20. The method of claim 18 wherein said axis of said source collimator window forms an acute angle with said major axis of said collar.

21. The method of claim 18 wherein said axis of said short spaced detector collimator window forms an acute angle with said major axis of said collar.

22. The method of claim 15 comprising the additional step of removably mounting said gamma ray source into said instrument package framework.

23. The method of claim 15 wherein said gamma ray source comprises cesium-137.

24. An LWD logging system comprising:

(a) an instrument package framework with a source holder cavity therein, and wherein (i) said instrument package is disposed within an instrument package cavity in a wall of a drill collar, (ii) said drill collar is defined by an inner collar surface and an outer collar surface, and (iii) said instrument package cavity opens at said outer collar surface; and (b) a source holder with a source of radiation affixed thereto, wherein said source holder removably mounted within said source holder cavity.

25. The system of claim 24 wherein:

(a) said source holder is threaded;

(b) said source holder cavity is lined with an insert and said insert is threaded to receive said source holder; and (c) said source holder material enhances mechanical strength of said threads within said source holder cavity.

26. The system of claim 24 wherein said instrument package framework comprises high Z material.

27. The system of claim 26 wherein said source of radiation is a gamma radiation source.

28. The system of claim 26 further comprising a pathway in said high Z material extending radially outward from said source of radiation thereby forming a source collimator window, wherein:

(a) the axis of said source collimator window is in a plane defined by the major axis of said collar and the radial center of said instrument package framework;

(b) said source collimator window is filled with a low Z material; and (c) said source is positioned in said instrument package within a radius defined by said outer collar surface.

29. The system of claim 28 wherein the major axis of said threaded source holder cavity is perpendicular to said plane.

30. The system of claim 28 wherein said axis of said source collimator window forms an acute angle with said major axis of said collar.

* * * * *